US011828125B2

(12) United States Patent
Frankland et al.

(10) Patent No.: US 11,828,125 B2
(45) Date of Patent: Nov. 28, 2023

(54) CONNECTOR ASSEMBLY FOR MULTIPLE COMPONENTS

(71) Applicant: OneSubsea IP UK Limited, London (GB)

(72) Inventors: Jonathan Mark Frankland, Wakefield (GB); Scott Ward, Houston, TX (US); David Gwyn, Tomball, TX (US); Sean Ainsworth, Leeds (GB)

(73) Assignee: OneSubsea IP UK Limited, London (GB)

( * ) Notice: Subject to any disclaimer, the term of this patent is extended or adjusted under 35 U.S.C. 154(b) by 70 days.

(21) Appl. No.: 17/397,571

(22) Filed: Aug. 9, 2021

(65) Prior Publication Data

US 2022/0341275 A1 Oct. 27, 2022

Related U.S. Application Data

(60) Provisional application No. 63/178,241, filed on Apr. 22, 2021.

(51) Int. Cl.
*E21B 33/038* (2006.01)

(52) U.S. Cl.
CPC ..... *E21B 33/038* (2013.01)

(58) Field of Classification Search
CPC ..... E21B 33/038
See application file for complete search history.

(56) References Cited

U.S. PATENT DOCUMENTS

| | | | | |
|---|---|---|---|---|
| 994,230 | A * | 6/1911 | Yancey | F16L 37/1215 285/38 |
| 3,096,999 | A | 7/1963 | Ahlstone | |
| 4,491,346 | A | 1/1985 | Walker | |
| 7,316,430 | B2 * | 1/2008 | Biester | E21B 33/038 285/391 |
| 7,467,663 | B2 | 12/2008 | Reimert | |
| 7,766,581 | B2 * | 8/2010 | Munk | E21B 33/038 405/224.2 |
| 8,720,574 | B2 | 5/2014 | Cuiper et al. | |
| 10,161,229 | B2 | 12/2018 | Bekkevold | |
| 2014/0020905 | A1 | 1/2014 | Chen et al. | |
| 2017/0183933 | A1 | 6/2017 | Nguyen | |
| 2017/0254166 | A1 | 9/2017 | Berryhill | |
| 2018/0245433 | A1 | 8/2018 | Fuehring et al. | |

FOREIGN PATENT DOCUMENTS

WO 2017147667 A1 9/2017

OTHER PUBLICATIONS

Search Report and Written Opinion of International Patent Application No. PCT/US2022/025914 dated Aug. 10, 2022, 11 pages.

* cited by examiner

*Primary Examiner* — Aaron L Lembo
(74) *Attorney, Agent, or Firm* — Jeffrey D. Frantz

(57) ABSTRACT

A connector assembly for multiple components includes a dog having an engagement feature configured to engage a first component while the dog is in a locked position. The connector assembly also includes a lock ring disposed about the dog along a circumferential axis of the connector assembly. One of the dog or the lock ring includes a cam surface, the other of the dog or the lock ring includes a driver, and the driver is configured to move along the cam surface in response to rotation of the lock ring and/or the dog along the circumferential axis to drive the dog to the locked position.

16 Claims, 10 Drawing Sheets

CONNECTOR ASSEMBLY FOR MULTIPLE COMPONENTS

CROSS-REFERENCE TO RELATED APPLICATION

This application claims priority from and the benefit of U.S. Provisional Application Ser. No. 63/178,241 entitled "CONNECTOR SYSTEM," filed Apr. 22, 2021, which is hereby incorporated by reference in its entirety.

BACKGROUND

The present disclosure relates generally to a connector assembly for multiple components.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Fluids (e.g., hydrocarbons) may be extracted from subsurface reservoirs and transported to the surface for commercial sales, such as for use in the power industry, transportation industry, manufacturing industry, and other applicable industries. For example, a well may be drilled into the ground to a subsurface reservoir, and equipment may be installed in the well and on the surface to facilitate extraction of the fluids. In some cases, the wells may be offshore (e.g., subsea), and the equipment may be disposed underwater, on offshore platforms, and/or on floating systems.

In some drilling and production systems, a connector assembly is used to couple two resource extraction system components to one another. For example, a connector assembly may be used to couple a production tree to a tubing spool. The connector assembly may include an outer body bolted to one component (e.g., a production tree) and an inner body. The inner body may support multiple dogs, and each dog may have teeth configured to engage corresponding teeth of the other component (e.g., a tubing spool). The connector assembly may also include an actuator positioned between the inner and outer bodies. The actuator may include a cam surface configured to engage a corresponding surface of each dog, and the actuator may be driven upwardly and downwardly along a longitudinal axis of the connector assembly (e.g., via application of hydraulic fluid to opposite ends of the actuator). As the actuator is driven in a first direction (e.g., downwardly) along the longitudinal axis, the cam surface drives each dog to a locked position, thereby coupling the respective component (e.g., the tubing spool) to the connector assembly. In addition, as the actuator is driven in a second direction (e.g., upwardly) along the longitudinal axis, the cam surface moves to a position that enables each dog to move to an unlocked position, thereby enabling removal of the respective component (e.g., the tubing spool) from the connector assembly.

The longitudinal extents of the inner body and the outer body may be selected to accommodate the longitudinal extent and the longitudinal range of motion of the actuator. Accordingly, the connector assembly may have a significant longitudinal extent, which increases the weight and the cost of the connector assembly. In addition, due to the longitudinal extent of the connector assembly, the connector assembly may experience a significant bending load. As a result, the inner and outer bodies may have significant thickness to resist such a bending load, thereby further increasing the weight and the cost of the connector assembly.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In certain embodiments, a connector assembly for multiple components includes a dog having teeth configured to engage a first component while the dog is in a locked position. The connector assembly also includes a lock ring disposed about the dog along a circumferential axis of the connector assembly. One of the dog or the lock ring includes a cam surface, the other of the dog or the lock ring includes a driver, and the driver is configured to move along the cam surface in response to rotation of the lock ring and/or the dog along the circumferential axis to drive the dog to the locked position.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
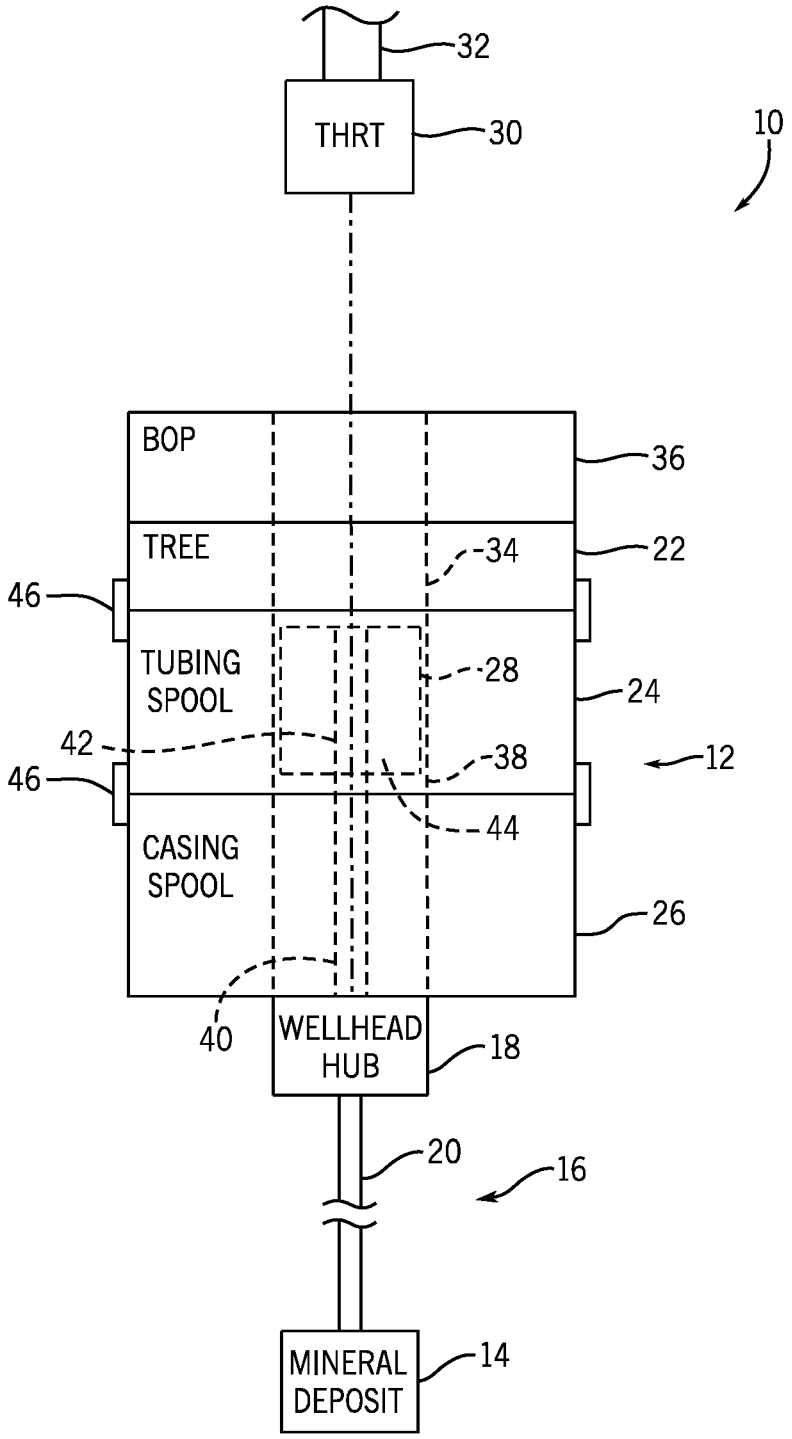
FIG. 1 is a block diagram of an embodiment of a resource extraction system.

Specific embodiments of the present disclosure are described below. To provide a concise description of these embodiments, all features of an actual implementation may not be described in the specification. It should be appreciated that in the development of any such actual implementation, as in any engineering or design project, numerous implementation-specific decisions are made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the elements.

As explained above, certain connector assemblies include an actuator that moves upwardly and downwardly along a longitudinal axis to control the position of dogs. Accordingly, the longitudinal extents of an inner body and an outer body of the connector assembly are selected to accommodate the longitudinal extent and the longitudinal range of motion of the actuator. As a result, the connector assembly may have a significant longitudinal extent, which increases the weight and the cost of the connector assembly. In addition, due to the longitudinal extent of the connector assembly, the connector assembly may experience a significant bending load. As a result, the inner and outer bodies may have significant thickness to resist such a bending load, thereby further increasing the weight and the cost of the connector assembly.

In certain embodiments disclosed herein, a connector assembly for multiple components (e.g., resource extraction system components) includes a dog having an engagement feature (e.g., teeth, etc.) configured to engage a first component (e.g., tubing spool) while the dog is in a lock position. The connector assembly also includes a lock ring disposed about the dog along a circumferential axis of the connector assembly. One of the dog or the lock ring includes a cam surface, and the other of the dog or the lock ring includes a driver. The driver is configured to move along the cam surface in response to rotation of the lock ring along the circumferential axis to drive the dog to the locked position. Because the lock ring is disposed about the dog along the circumferential axis, the longitudinal extent (e.g., height) of the connector assembly may be reduced (e.g., as compared to a connector assembly having an actuator that moves along the longitudinal axis). As a result, the weight and the cost of the connector assembly may be significantly reduced.

FIG. 1 is a block diagram of an embodiment of a resource extraction system 10. The resource extraction system 10 may be configured to extract various minerals and natural resources, including hydrocarbons (e.g., oil and/or natural gas) from the earth, or the resource extraction system may be configured to inject substances into the earth. In some embodiments, the resource extraction system 10 is land-based (e.g., a surface system) or subsea (e.g., a subsea system). As illustrated, the resource extraction system 10 includes a wellhead 12 coupled to a mineral deposit 14 via a well 16. The well 16 includes a wellhead hub 18 and a well-bore 20. The wellhead hub 18 may include a large diameter hub that is disposed at the termination of the well-bore 20. The wellhead hub 18 provides for the connection of the wellhead 12 to the well 16.

The wellhead 12 includes multiple components that control and regulate activities and conditions associated with the well 16. For example, the wellhead 12 may include bodies, valves, and seals that route produced minerals from the mineral deposit 14, provide for regulating pressure in the well 16, and provide for the injection of chemicals into the well-bore 20 (down-hole). In the illustrated embodiment, the wellhead 12 includes a production tree 22, a tubing spool 24, a casing spool 26, and a tubing hanger 28. The resource extraction system 10 may include other device(s) that are coupled to the wellhead 12 and/or device(s) that are used to assemble and/or control various components of the wellhead 12. For example, in the illustrated embodiment, the resource extraction system 10 includes a tubing hanger running tool (THRT) 30 suspended from a drill string 32. In certain embodiments, the tubing hanger 28 supports tubing (e.g., a tubing string). During a running or lowering process, the THRT 30 is coupled to the tubing hanger 28, thereby coupling the tubing hanger 28 to the drilling string 32. The THRT 30, which is coupled to the tubing hanger 28, is lowered (e.g., run) from an offshore vessel to the wellhead 12. Once the tubing hanger 28 has been lowered into a landed position within the tubing spool 24, the tubing hanger 28 may be permanently locked into position. The THRT 30 may then be uncoupled from the tubing hanger 28 and extracted from the wellhead 12 by the drilling string 32, as illustrated. While the tubing hanger 28 is landed in the tubing spool 24 in the illustrated embodiment, in other embodiments, the tubing spool may be omitted, and the tubing hanger may be landed in another suitable portion of the wellhead.

The production tree 22 may include a variety of flow paths (e.g., bores), valves, fittings, and controls for operating the well 16. For instance, the production tree 22 may include a frame that is disposed about a tree body, a flow-loop, actuators, and valves. Further, the production tree 22 may be in fluid communication with the well 16. As illustrated, the production tree 22 includes a tree bore 34. The tree bore 34 provides for completion and workover procedures, such as the insertion of tools (e.g., the tubing hanger 28) into the wellhead 12, the injection of various chemicals into the well 16 (down-hole), and the like. Further, minerals extracted from the well 16 (e.g., oil and/or natural gas) may be regulated and routed via the production tree 22. For instance, the production tree 22 may be coupled to a jumper or a flowline that is tied back to other components, such as a manifold. Accordingly, produced minerals flow from the well 16 to the manifold via the production tree 22 before being routed to shipping or storage facilities. A blowout preventer (BOP) 36 may also be included, either as a part of the production tree 22 or as a separate device. The BOP 36 may include a variety of valves, fittings, and controls to block oil, gas, or other fluid from exiting the well in the event of an unintentional release of pressure or an overpressure condition.

The tubing spool 24 provides a base for the production tree 22. The tubing spool 24 may be one of many components in a modular subsea resource extraction system 10 that is run from an offshore vessel. The tubing spool 24 includes a tubing spool bore 38, and the casing spool 26 includes a casing spool bore 40. The bores 38 and 40 connect (e.g., enable fluid communication between) the tree bore 34 and the well 16. Thus, the bores 38 and 40 may provide access to the well-bore 20 for various completion and workover procedures. For example, components may be run down to the wellhead 12 and disposed in the tubing spool bore 38 and/or the casing spool bore 40 to seal-off the well-bore 20, to inject chemicals down-hole, to suspend tools down-hole, to retrieve tools, and the like.

The well-bore 20 may contain elevated fluid pressures. For example, pressures within the well-bore 20 may exceed 10,000 pounds per square inch (PSI), 15,000 PSI, or 20,000 PSI. Accordingly, resource extraction systems 10 employ various mechanisms, such as mandrels, seals, plugs, and valves, to control and regulate the well 16. For example, the illustrated tubing hanger 28 may be disposed within the wellhead 12 to secure tubing suspended in the well-bore 20, and to provide a path for hydraulic control fluid, chemical injection, electrical connection(s), fiber optic connection(s), and the like. The tubing hanger 28 includes a central bore 42 that extends through the center of a body 44 of the tubing hanger 28, and that is in fluid communication with the well-bore 20. The central bore 42 is configured to facilitate flow of hydrocarbons through the body 44 of the tubing hanger 28.

In the illustrated embodiment, the resource extraction system 10 includes a first connector assembly 46 configured to couple the production tree 22 to the tubing spool 24. The resource extraction system 10 also includes a second connector assembly 46 configured to couple the tubing spool 24 to the casing spool 26. As discussed in detail below, each connector assembly 46 includes a dog having teeth configured to engage a first component (e.g., the tubing spool 24 for the first connector assembly and the casing spool 26 for the second connector assembly) while the dog is in a locked position. In addition, the connector assembly 46 includes a lock ring disposed about the dog along a circumferential axis of the connector assembly. One of the dog or the lock ring includes a cam surface, and the other of the dog or the lock ring includes a driver. The driver is configured to move along the cam surface in response to rotation of the lock ring along the circumferential axis to drive the dog to the locked position. With the dog in the locked position, a second component (e.g., the production tree 22 for the first connector assembly and the tubing spool 24 for the second connector assembly) is coupled to the first component. Because the lock ring is disposed about the dog along the circumferential axis, the longitudinal extent (e.g., height) of the connector assembly may be reduced (e.g., as compared to a connector assembly having an actuator that moves along the longitudinal axis). As a result, the weight and the cost of the connector assembly may be significantly reduced. While the resource extraction system 10 includes two connector assemblies 46 in the illustrated embodiment, in other embodiments, the resource extraction system may include more or fewer connector assemblies (e.g., 1, 3, 4, or more). Furthermore, while the first connector assembly 46 is configured to couple the production tree 22 to the tubing spool 24 and the second connector assembly 46 is configured to couple the tubing spool 24 to the casing spool 26 in the illustrated embodiment, in other embodiments, the connector assembly disclosed herein may be configured to couple any two suitable components of the resource extraction system 10 to one another. For example, the connector assembly may be configured to couple the production tree to a wellhead high pressure housing, the connector assembly may be configured to couple a spool to a wellhead high pressure housing, the connector assembly may be configured to couple a tree export to a flow base, the connector assembly may be configured to couple a tree export to the tubing spool, the connector assembly may be configured to couple the production tree to a flowline jumper, or the connector assembly may be configured to couple any other suitable first resource extraction system component to any other suitable second resource extraction system component (e.g., including a tree intervention cap device, a flowline, a retrievable mount, intervention well equipment, export and distribution equipment, etc.). Furthermore, the connector assembly may be employed within any suitable wellhead configuration (e.g., in a wellhead having a vertical tree, a horizontal tree, or a hybrid tree). While the connector assembly is disclosed herein with regard to a resource extraction system, the connector assembly may be configured to couple any two suitable components (e.g., pressure-containing structural components, non-pressure-containing mechanical components, etc.) to one another. For example, the connector assembly may be configured to couple two pressure-containing structural components to one another to establish a substantially leak-tight seal while the pressure-containing structural components are subjected to internal and/or external loads/moments.

Figure 2:
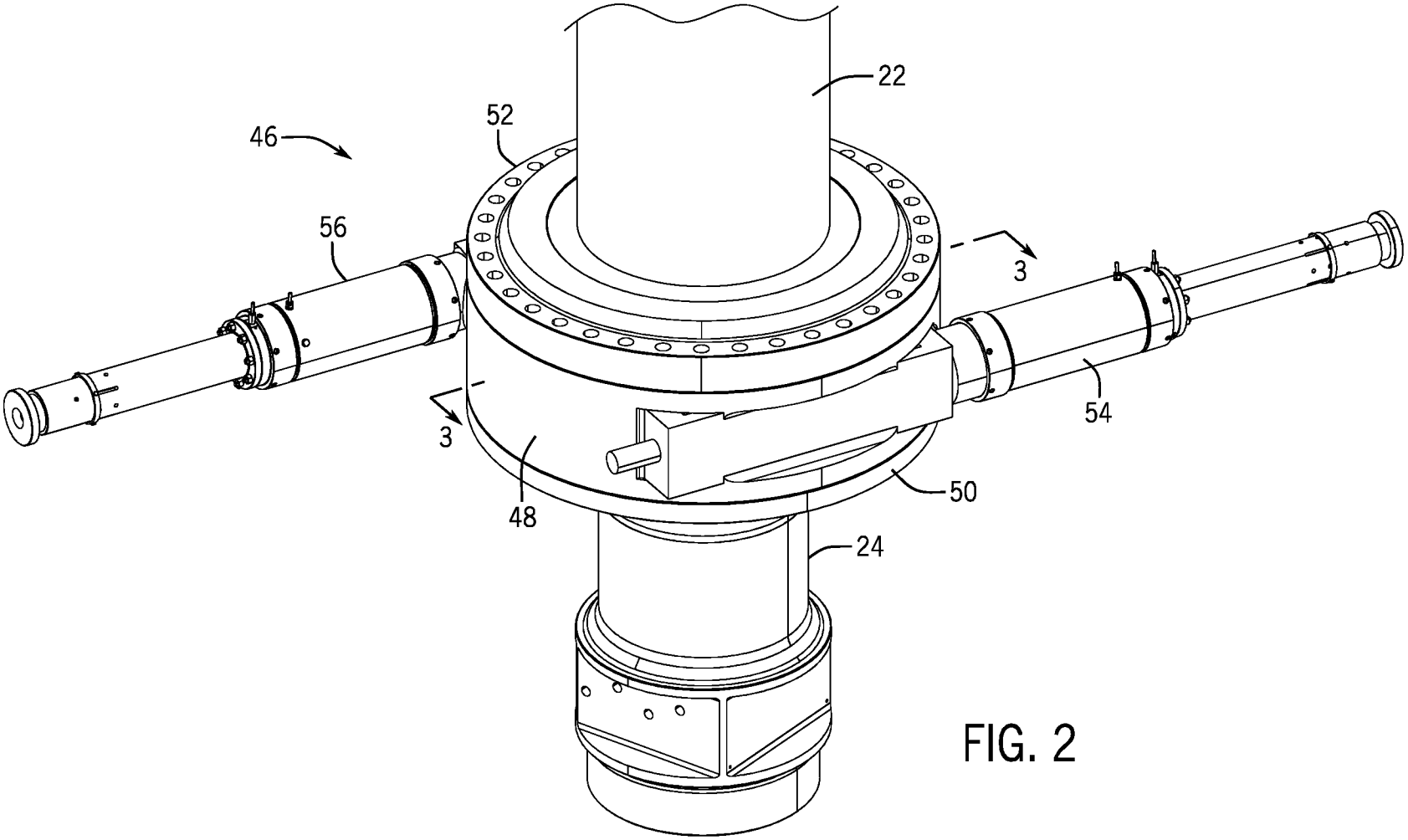
FIG. 2 is a perspective view of an embodiment of a connector assembly that may be employed within the resource extraction system of FIG. 1.

FIG. 2 is a perspective view of an embodiment of a connector assembly 46 that may be employed within the resource extraction system of FIG. 1. In the illustrated embodiment, the connector assembly 46 is configured to couple the production tree 22 to the tubing spool 24. However, as previously discussed, the connector assembly 46 may be configured to couple any two suitable components (e.g., resource extraction system components) to one another. As discussed in detail below, the connector assembly 46 includes one or more dogs and a lock ring disposed about the dog(s) along a circumferential axis of the connector assembly 46. In addition, the connector assembly 46 includes an outer body 48, an inner body 50, and a top plate 52. The outer body 48 is configured to house the dog(s) and the lock ring, and the inner body 50 is configured to support the dogs within the outer body 48. The top plate 52 is configured to engage the production tree 22 and to retain the dog(s) and the lock ring within the outer body 48.

Furthermore, in the illustrated embodiment, the connector assembly 46 includes a first actuator 54 and a second actuator 56. The actuators are configured to drive the lock ring to rotate, thereby selectively driving the dog(s) to a locked position and enabling the dog(s) to move to an unlocked position. As discussed in detail below, each dog includes teeth configured to engage the tubing spool 24 (e.g., first component) while the dog is in the locked position, thereby coupling the tubing spool 24 to the connector assembly 46. In addition, each dog has a cam surface, and the lock ring includes one or more drivers (e.g., one or more drivers for each dog). Each driver is configured to move along the cam surface of a respective dog in response to rotation of the lock ring along the circumferential axis to drive the respective dog to the locked position. For example, the actuators may be configured to drive the lock ring in a first direction to an engaged position, thereby driving each dog to the locked position. As a result, the tubing spool 24 is coupled to the connector assembly 46. In addition, the actuators may be configured to drive the lock ring in a second direction, opposite the first direction, to a disengaged position that enables each dog to move to an unlocked position, thereby facilitating separation of the tubing spool 24 from the connector assembly 46. Because the lock ring is disposed about the dog(s) along the circumferential axis, the longitudinal extent (e.g., height) of the connector assembly may be reduced (e.g., as compared to a connector assembly having an actuator that moves along the longitudinal axis). As a result, the weight and the cost of the connector assembly may be significantly reduced. While the connector assembly 46 includes two actuators in the illustrated embodiment, in other embodiments, the connector assembly may include more or fewer actuators (e.g., 1, 3, 4, 5, 6, or more).

In certain embodiments, each dog may include a lug configured to engage the production tree 22 (e.g., second component) while the dog is in the locked position, thereby coupling the production tree to the connector assembly 46. In addition, the lug of each dog may disengage the production tree 22 while the dog is in the unlocked position, thereby facilitating separation of the production tree 22 from the connector assembly 46. Because the dog(s) are engaged with both components, longitudinal forces (e.g., longitudinal forces driving the components away from one another along the longitudinal axis) may extend directly through the dog(s). As a result, the weight and the cost of the connector assembly may be reduced (e.g., as compared to a connector assembly in which the second component is bolted to a body of the connector assembly, and the connector assembly elements have sufficient thickness to resist the loading caused by the longitudinal forces flowing along a tortuous path through the connector assembly between the components).

Figure 3:
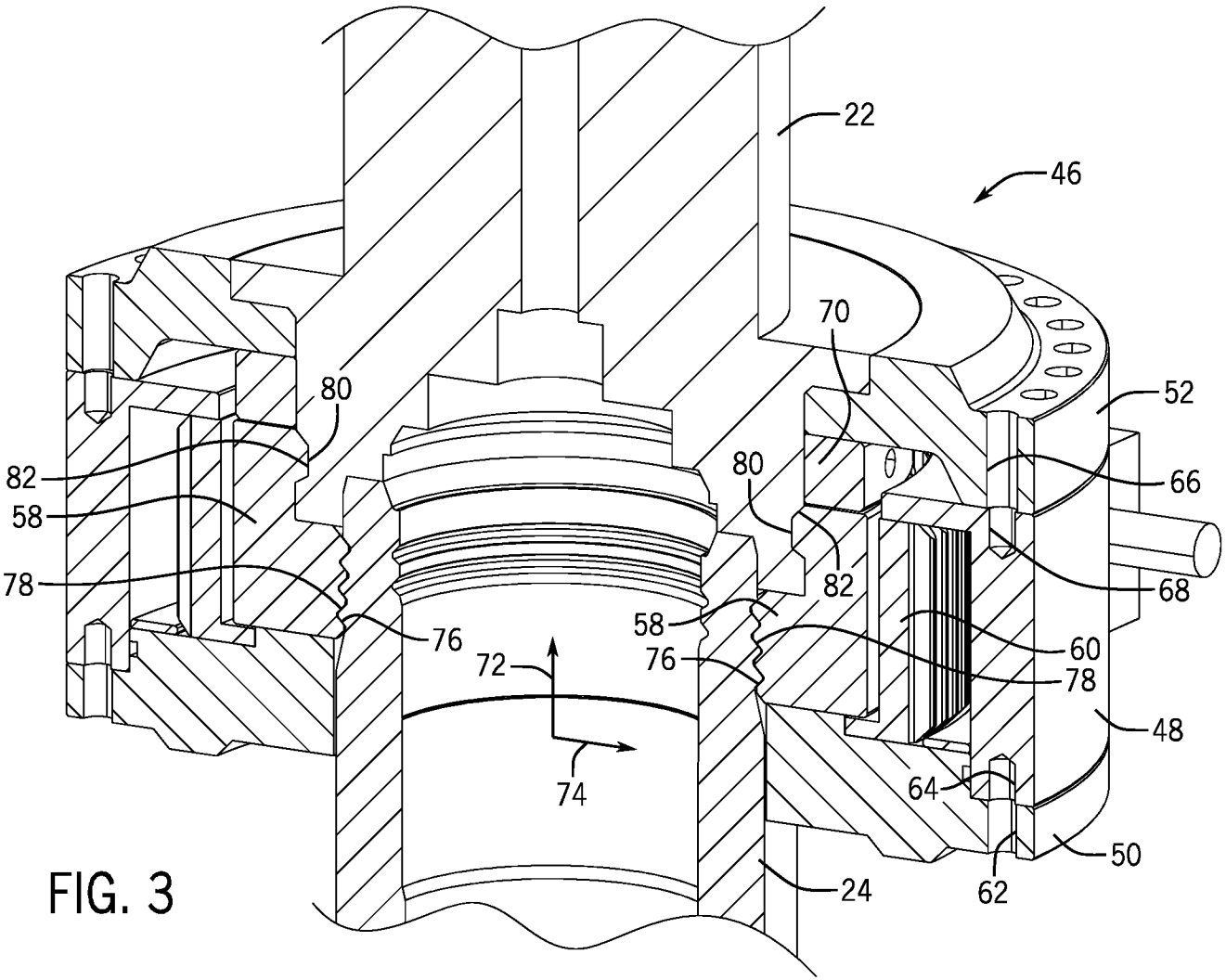
FIG. 3 is a cross-sectional view of the connector assembly of FIG. 2, taken along line 3-3 of FIG. 2.

FIG. 3 is a cross-sectional view of the connector assembly 46 of FIG. 2, taken along line 3-3 of FIG. 2. As previously discussed, the connector assembly 46 includes one or more dogs 58 and a lock ring 60 disposed about the dogs 58 along the circumferential axis of the connector assembly 46. As illustrated, the dogs 58 are supported by the inner body 50, and the dogs 58 and the lock ring 60 are housed within the outer body 48. In the illustrated embodiment, the inner body 50 has apertures 62, and the outer body 48 has corresponding recesses 64. Fasteners may be disposed through the apertures 62 of the inner body 50 and engaged with the recesses 64 of the outer body 48, thereby coupling the inner body 50 to the outer body 48. However, in other embodiments, the inner and outer bodies may be coupled to one another by any other suitable connection(s) (e.g., alone or in combination with the fasteners), such as welded connection(s), adhesive connection(s), clamped connection(s), other suitable connection(s), or a combination thereof. Furthermore, as previously discussed, the top plate 52 is configured to engage the production tree 22 and to retain the dogs 58 and the lock ring 60 within the outer body 48. In the illustrated embodiment, the top plate 52 has apertures 66, and the outer body 48 has corresponding recesses 68. Fasteners may be disposed through the apertures 66 of the top plate 52 and engaged with the recesses 68 of the outer body 48, thereby coupling the top plate 52 to the outer body 48. However, in other embodiments, the top plate and the outer body may be coupled to one another by any other suitable connection(s) (e.g., alone or in combination with the fasteners), such as welded connection(s), adhesive connection(s), clamped connection(s), other suitable connection(s), or a combination thereof. Furthermore, in the illustrated embodiment, a spacing ring 70 is positioned between the dogs 58 and the top plate 52. The spacing ring 70 is configured to substantially block movement of the dogs 58 along a longitudinal axis 72 and to enable movement of the dogs 58 along a radial axis 74. While the connector assembly 46 includes the spacing ring 70 in the illustrated embodiment, in other embodiments, the spacing ring may be omitted (e.g., in embodiments in which the top plate contacts the dogs). In addition, while the structure surrounding the dogs and the lock ring is formed by the top plate, the outer body, and the inner body in the illustrated embodiment, in other embodiments, the structure of the connector assembly surrounding the dogs and the lock ring may be formed from any other suitable element(s).

In the illustrated embodiment, each dog 58 has teeth 76 (e.g., an engagement feature) configured to engage corresponding teeth 78 (e.g., a corresponding engagement feature) of the tubing spool 24 (e.g., first component) while the dog 58 is in the illustrated locked position, thereby coupling the tubing spool 24 to the connector assembly 46. In addition, each dog 58 has a cam surface, and the lock ring 60 includes one or more drivers (e.g., one driver for each dog). Each driver is configured to move along the cam surface of a respective dog 58 in response to rotation of the lock ring 60 along the circumferential axis of the connector assembly to drive the respective dog 58 along the radial axis 74 to the locked position. For example, as previously discussed, the actuators may be configured to drive the lock ring 60 in a first direction to an engaged position, thereby driving each dog 58 along the radial axis 74 to the locked position. As a result, the tubing spool 24 is coupled to the connector assembly 46. In addition, the actuators may be configured to drive the lock ring 60 in a second direction, opposite the first direction, to a disengaged position that enables each dog 58 to move along the radial axis 74 to an unlocked position, in which the teeth 76 of the dog 58 are disengaged from the teeth 78 of the tubing spool 24, thereby facilitating separation of the tubing spool 24 from the connector assembly 46. While each dog includes teeth in the embodiments disclosed herein, in certain embodiments, at least one dog may include another suitable engagement feature (e.g., lug, a recess, a protrusion, a groove, etc.) configured to selectively engage the respective component (e.g., a corresponding engagement feature of the respective component).

In the illustrated embodiment, each dog 58 includes a lug 80 (e.g., second engagement feature) configured to engage a corresponding recess 82 (e.g., a corresponding second engagement feature) of the production tree 22 (e.g., second component) while the dog 58 is in the locked position, thereby coupling the production tree to the connector assembly 46. For example, the actuators may be configured to drive the lock ring 60 in the first direction to the engaged position, thereby driving each dog 58 along the radial axis 74 to the locked position. As a result, the production tree 22 is coupled to the connector assembly 46. In addition, the lug 80 of each dog 58 may disengage the production tree 22 while the dog 58 is in the unlocked position, thereby facilitating separation of the production tree 22 from the connector assembly 46. For example, the actuators may be configured to drive the lock ring 60 in the second direction, opposite the first direction, to the disengaged position that enables each dog 58 to move along the radial axis 74 to the unlocked position, in which the lug 80 of the dog 58 is disengaged from the recess 82 of the production tree 22, thereby facilitating separation of the production tree 22 from the connector assembly 46. Because the dogs are engaged with both components, longitudinal forces (e.g., longitudinal forces driving the components away from one another along the longitudinal axis) may extend directly through the dogs. As a result, the weight and the cost of the connector assembly may be reduced (e.g., as compared to a connector assembly in which the production tree is bolted to a body of the connector assembly, and the connector assembly elements have sufficient thickness to resist the loading caused by the longitudinal forces flowing along a tortuous path through the connector assembly between the components). While each dog includes a respective lug in the embodiments disclosed herein, in certain embodiments, at least one dog may include another suitable second engagement feature (e.g., teeth, a recess, a protrusion, a groove, etc.) configured to selectively engage the respective component (e.g., a corresponding engagement feature of the respective component). Furthermore, in certain embodiments, the lug(s)/second engagement feature(s) of the dog(s) may be omitted, and the production tree may be coupled (e.g., by fastener(s), etc.) to at least one other element of the connector assembly (e.g., the outer body, etc.).

Figure 4:
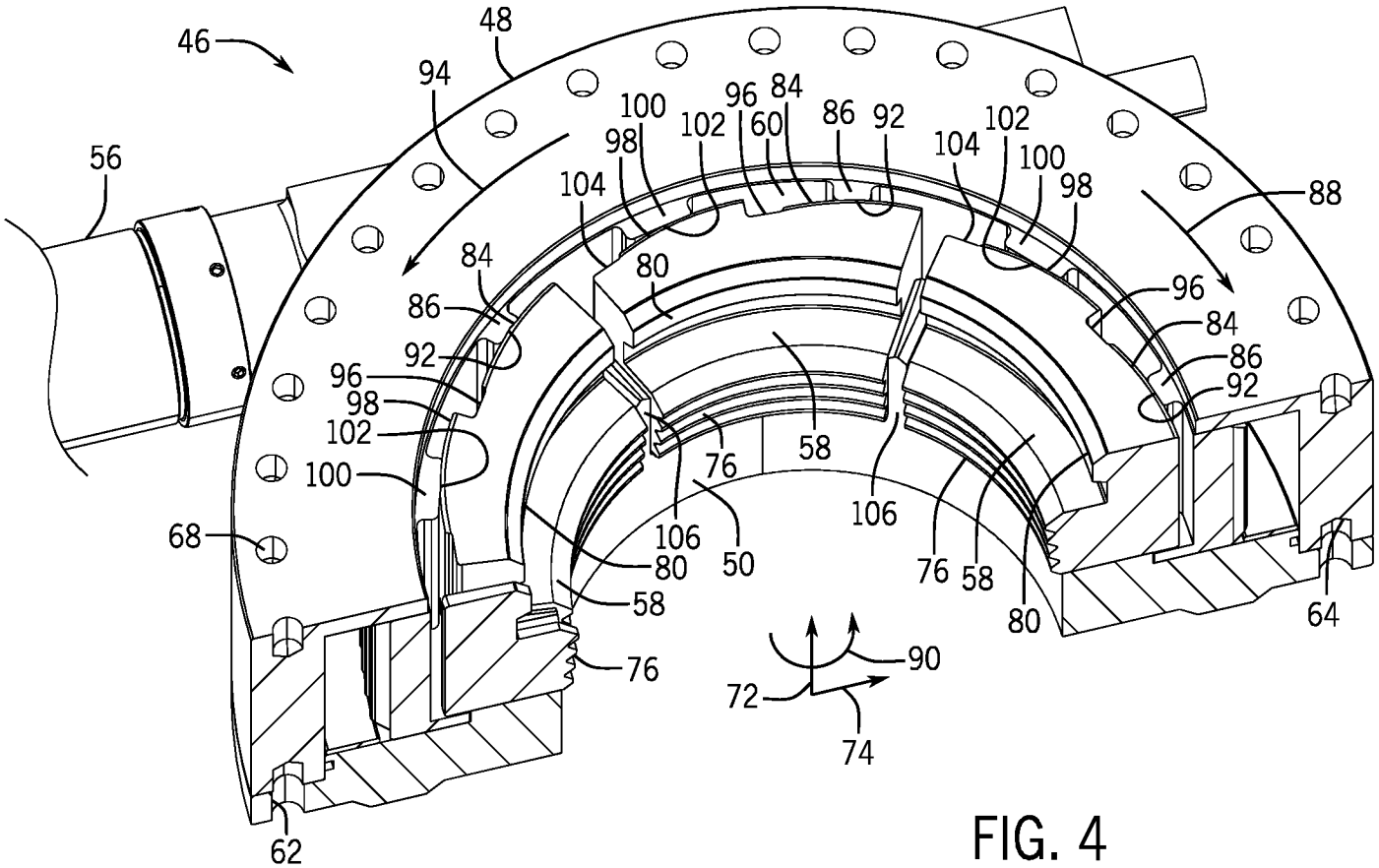
FIG. 4 is a cross-sectional view of a portion of the connector assembly of FIG. 2, in which each dog of the connector assembly is in a locked position.

FIG. 4 is a cross-sectional view of a portion of the connector assembly 46 of FIG. 2, in which each dog 58 of the connector assembly 46 is in the locked position. As previously discussed, each dog 58 includes a cam surface 84, and the lock ring 60 includes drivers 86 (e.g., one driver for each dog). Each driver 86 is configured to move along the cam surface 84 of a respective dog 58 in response to rotation of the lock ring 60 along the circumferential axis to drive the respective dog 58 along the radial axis 74 to the illustrated locked position. For example, the actuators may drive the lock ring 60 in a first direction 88 along the circumferential axis 90 to the engaged position, thereby driving each dog 58 inwardly along the radial axis 74 to the locked position. As a result, the teeth 76 of the dogs 58 apply a substantial force to the tubing spool, thereby coupling the tubing spool to the connector assembly 46. In addition, the lugs 80 of the dogs 58 apply a substantial force to the production tree, thereby coupling the production tree to the connector assembly 46. In the illustrated embodiment, an engagement surface 92 of each driver 86 is configured to engage the cam surface 84 of the respective dog 58 at a self-locking angle while the dog 58 is in the illustrated locked position. Accordingly, each dog 58 may remain locked in the illustrated locked position without application of force by the actuators, thereby reducing actuator power consumption. As used herein, "self-locking" refers to a condition in which the static friction between the opposing surfaces is greater than the force(s) driving the respective opposing elements to slide relative to one another. In certain embodiments, the angle of the engagement surface 92 of the driver 86 (e.g., the angle of line(s) tangent to the engagement surface 92) and the angle of the cam surface 84 of the dog 58 (e.g., the angle of line(s) tangent to the cam surface 84) may be about 3 degrees to about 6 degrees relative to the circumferential axis 90 (e.g., at least at the point/line/area of contact between the engagement surface 92 of the driver 86 and the cam surface 84 of the dog 58), such that the engagement surface 92 of the driver 86 engages the cam surface 84 of the dog 58 at the self-locking angle while the dog 58 is in the illustrated locked position. In other embodiments, the angle of the engagement surface 92 of the driver 86 and the angle of the cam surface 84 of the dog 58 may be about 3 degrees to about 5 degrees relative to the circumferential axis 90, such that the engagement surface 92 of the driver 86 engages the cam surface 84 of the dog 58 at the self-locking angle while the dog 58 is in the illustrated locked position. In other embodiments, the angle of the engagement surface 92 of the driver 86 and the angle of the cam surface 84 of the dog 58 may be about 3 degrees to about 4 degrees relative to the circumferential axis 90, such that the engagement surface 92 of the driver 86 engages the cam surface 84 of the dog 58 at the self-locking angle while the dog 58 is in the illustrated locked position. In other embodiments, the angle of the engagement surface 92 of the driver 86 and the angle of the cam surface 84 of the dog 58 may be about 3.5 degrees to about 6 degrees relative to the circumferential axis 90, such that the engagement surface 92 of the driver 86 engages the cam surface 84 of the dog 58 at the self-locking angle while the dog 58 is in the illustrated locked position. In other embodiments, the angle of the engagement surface 92 of the driver 86 and the angle of the cam surface 84 of the dog 58 may be about 3.5 degrees to about 5 degrees relative to the circumferential axis 90, such that the engagement surface 92 of the driver 86 engages the cam surface 84 of the dog 58 at the self-locking angle while the dog 58 is in the illustrated locked position. While the engagement surface of each driver is configured to engage the cam surface of the respective dog at the self-locking angle while the dog is in the locked position in the illustrated embodiment, in other embodiments, the engagement surface of at least one driver may be configured to engage the cam surface of the respective dog(s) at another suitable angle while the respective dog(s) are in the locked position.

Furthermore, the actuators may drive the lock ring 60 in a second direction 94 along the circumferential axis 90, opposite the first direction 88, to the disengaged position, thereby enabling each dog 58 to move outwardly along the radial axis 74 to the unlocked position. With each dog 58 in the unlocked position, the teeth 76 of the dogs are disengaged from the corresponding teeth of the tubing spool, and the lugs 80 of the dogs 58 are disengaged from the recess of the production tree, thereby facilitating separation of the tubing spool and the production tree from the connector assembly 46. In the illustrated embodiment, each dog 58 includes a recess 96 positioned adjacent to the respective cam surface 84. The recess 96 is configured to receive the respective driver 86 while the dog 58 is in the unlocked position. In addition, the recess 96 enables the cam surface 84 to be oriented at a shallower angle (e.g., as compare to a dog without the recess), thereby facilitating engagement of the driver with the cam surface at the self-locking angle. While each dog includes a recess in the illustrated embodiment, in other embodiments, at least one dog may not include a recess.

In the illustrated embodiment, each dog 58 includes a second cam surface 98, and the lock ring 60 includes second drivers 100 (e.g., one second driver for each dog). Each second driver 100 is configured to move along the second cam surface 98 of a respective dog 58 in response to rotation of the lock ring 60 along the circumferential axis 90 to drive the respective dog 58 along the radial axis 74 to the illustrated locked position (e.g., to establish a force between the teeth of the dogs and the tubing spool sufficient to couple the tubing spool to the connector assembly and to establish a force between the lugs of the dogs and the production tree sufficient to couple the production tree to the connector assembly). In certain embodiments, an engagement surface 102 of each second driver 100 is configured to engage the second cam surface 98 of the respective dog 58 at a self-locking angle while the dog 58 is in the illustrated locked position. For example, the angle of the engagement surface 102 of the second driver 100 (e.g., the angle of line(s) tangent to the engagement surface 102) and the angle of the second cam surface 98 of the dog 58 (e.g., the angle of line(s) tangent to the second cam surface 98) may be about 3 degrees to about 6 degrees relative to the circumferential axis 90 (e.g., at least at the point/line/area of contact between the engagement surface 102 of the second driver 100 and the second cam surface 98 of the dog 58), such that the engagement surface 102 of the second driver 100 engages the second cam surface 98 of the dog 58 at the self-locking angle while the dog 58 is in the illustrated locked position. In addition, each second driver 100 and each second cam surface 98 may enable the respective dog 58 to move to the unlocked position while the lock ring is in the disengaged position. For example, in certain embodiments, each dog includes a second recess 104 positioned adjacent to the respective second cam surface 98. In such embodiments, the second recess 104 is configured to receive the respective second driver 100 while the dog 58 is in the unlocked position.

While each dog has two cam surfaces in the illustrated embodiment, in other embodiments, at least one dog may have more or fewer cam surfaces (e.g., 1, 3, 4, or more). In addition, the lock ring may have a driver for each cam surface of each dog. Furthermore, while the lock ring has drivers and each dog has cam surface(s) in the illustrated embodiment, in other embodiments, at least one dog may have at least one driver, and the lock ring may have at least one cam surface. For example, in certain embodiments, each dog may have a driver, and the lock ring may have a respective cam surface for each driver. In such embodiments, an engagement surface of at least one driver may be configured to engage the respective cam surface at a self-locking angle while the respective dog is in the locked position. Additionally or alternatively, the lock ring may include at least one recess configured to receive a respective driver while the respective dog is in the unlocked position.

In the illustrated embodiment, the inner body 50 includes spacers 106, and each spacer 106 is positioned between adjacent dogs 58 along the circumferential axis 90. Accordingly, each dog 58 is guided along the radial axis 74 between the locked and unlocked positions. While the inner body includes the spacers in the illustrated embodiment, in other embodiments, at least one spacer may be part of another suitable element of the connector assembly (e.g., the outer body, the top plate, etc.), and/or at least one spacer may be a separate element (e.g., couple to the inner body, the outer body, the top plate, or a combination thereof). Furthermore, in the illustrated embodiment, the connector assembly 46 includes six dogs 58. However, in other embodiments, the connector assembly may include more or fewer dogs (e.g., 1, 2, 3, 4, 5, 7, 8, 9, 10, 11, 12, or more). Furthermore, each dog may have any suitable extent along the circumferential axis. For example, the dogs may have a combined circumferential extent of at least 270 degrees, at least 300 degrees, at least 320 degrees, at least 330 degrees, at least 340 degrees, or at least 350 degrees. Furthermore, in certain embodiments, circumferential surfaces of at least one pair of adjacent dogs may contact one another, and no spacer may be positioned between the dogs along the circumferential axis. While movement of each dog along the radial axis is guided by respective spacers in the illustrated embodiment, in other embodiments, movement of at least one dog (e.g., all of the dogs) may be guided by another suitable feature (e.g., a radially extending rod slidably coupled to a suitable element of the connector assembly and engaged with a recess of the dog, a radially extending rod coupled to the dog and slidably engaged with a recess in a suitable element of the connector assembly, a tongue and groove arrangement, a sliding mechanism, etc.). For example, at least one dog may include one or more radially extending ribs (e.g., on a top surface of the dog and/or on a bottom surface of the dog) configured to engage corresponding radially extending slot(s) of suitable element(s) of the connector assembly (e.g., the outer body, the inner body, the top plate, etc.) and/or one or more radially extending slots (e.g., on a top surface of the dog and/or on a bottom surface of the dog) configured to engage corresponding radially extending rib(s) of suitable element(s) of the connector assembly (e.g., the outer body, the inner body, the top plate, etc.).

Figure 5:
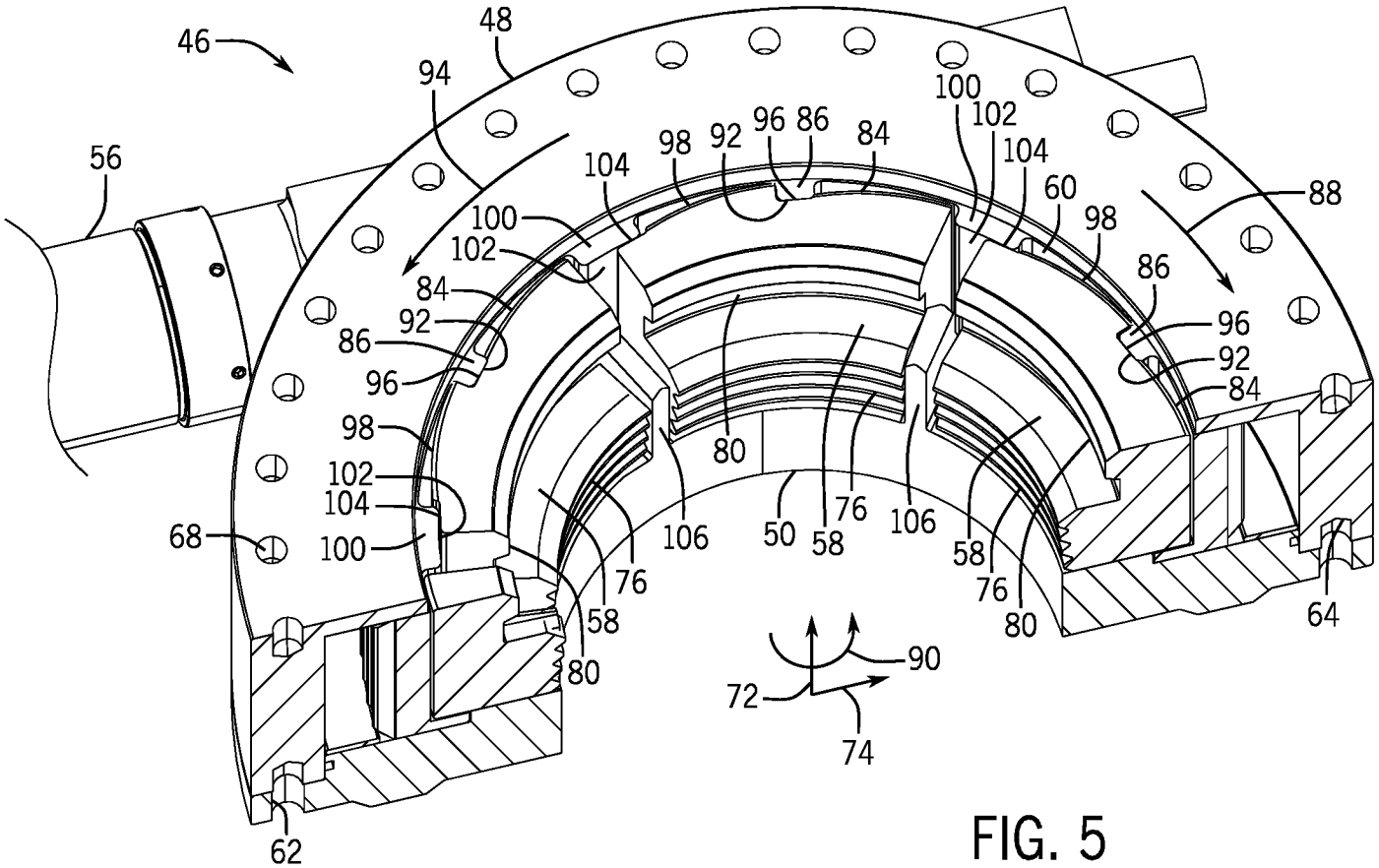
FIG. 5 is a cross-sectional view of a portion of the connector assembly of FIG. 2, in which each dog of the connector assembly is in an unlocked position.

FIG. 5 is a cross-sectional view of a portion of the connector assembly 46 of FIG. 2, in which each dog 58 of the connector assembly 46 is in the unlocked position. As illustrated, the lock ring 60 is in the disengaged position, which enables each dog 58 to move outwardly along the radial axis 74 to the unlocked position. With each dog 58 in the unlocked position, each driver 86 is disposed within the recess 96 of a respective dog 58, and each second driver 100 is disposed within the second recess 104 of a respective dog 58. Accordingly, the teeth 76 of the dogs 58 are disengaged from the tubing spool, and the lugs 80 of the dogs 58 are disengaged from the production tree. In certain embodiments, the teeth 76 of the dogs 58 are shaped to drive the dogs 58 outwardly along the radial axis 74 in response to movement of the tubing spool away from the connector assembly 46 along the longitudinal axis 72. Additionally or alternatively, the connector assembly may include one or more biasing devices (e.g., split ring(s), spring(s), etc.) configured to urge each dog outwardly along the radial axis 74 toward the unlocked position. Accordingly, while the lock ring is in the disengaged position, the biasing device(s) may drive each dog to the unlocked position. With each dog in the illustrated unlocked position, the connector assembly may be separated from the tubing spool and the production tree.

Figure 6:
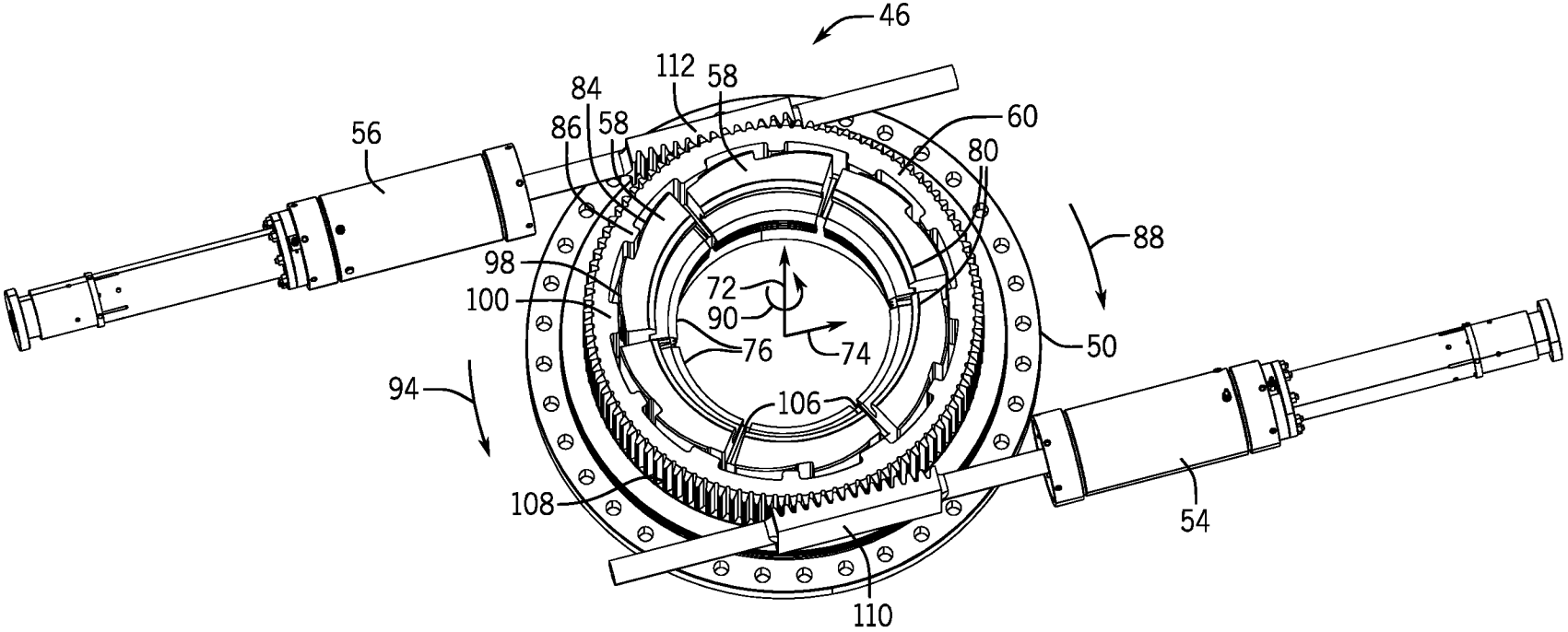
FIG. 6 is a perspective view of a portion of the connector assembly of FIG. 2.

FIG. 6 is a perspective view of a portion of the connector assembly 46 of FIG. 2. In the illustrated embodiment, the lock ring 60 includes a toothed surface 108 configured to drive the lock ring 60 to rotate in response to movement of corresponding structure(s) engaged with the toothed surface 108. Each corresponding structure may include any suitable structure configured to engage the toothed surface 108 and to drive the lock ring 60 to rotate. In the illustrated embodiment, the corresponding structure(s) includes a first rack 110 coupled to the first actuator 54 and a second rack 112 coupled to the second actuator 56. Each actuator may include any suitable linear actuating device(s), such as hydraulic cylinder(s), pneumatic cylinder(s), screw-drive mechanism(s), other suitable linear actuating device(s), or a combination thereof. The actuators are configured to drive the respective racks to move linearly, thereby driving the lock ring 60 to rotate along the circumferential axis 90. For example, the actuators may extend to drive the lock ring 60 to rotate in the first direction 88 to the engaged position, thereby driving each dog 58 to the locked position. In addition, the actuators may retract to drive the lock ring 60 to rotate in the second direction 94 to the disengaged position, thereby enabling each dog 50 to move to the unlocked position. Furthermore, in certain embodiments, at least one rack may have internal threads, and each respective actuator may include a threaded shaft engaged with the rack. The respective actuator may be configured to drive the threaded shaft to rotate, thereby driving the rack to move linearly.

In certain embodiments, one actuator may drive the lock ring to rotate between the engaged and disengaged positions during normal operation, and the other actuator may assist with driving the lock ring to the disengaged position in conditions in which the first actuator is incapable of providing sufficient force to drive the lock ring to the disengaged position. In addition, in certain embodiments, one actuator may drive the lock ring to rotate from the engaged position to the disengaged position, and the other actuator may drive the lock ring to rotate from the disengaged position to the engaged position. Furthermore, as previously discussed, the connector assembly may include more or fewer actuators (e.g., 1, 3, 4, 5, 6, or more), and/or each actuator may be coupled to multiple corresponding structures (e.g., via a mechanical linkage, a gear assembly, etc.). For example, a first set of one or more actuators may drive the lock ring to rotate between the engaged and disengaged positions during normal operation, and a second set of one or more actuators (e.g., partially overlapping the first set or separate from the first set) may assist with driving the lock ring to the disengaged position in conditions in which the first set of actuators is incapable of providing sufficient force to drive the lock ring to the disengaged position. By way of further example, a first set of one or more actuators may drive the lock ring to rotate from the engaged position to the disengaged position, and a second set of one or more actuators (e.g., partially overlapping the first set or separate from the first set) may drive the lock ring to rotate from the disengaged position to the engaged position.

In addition, while each corresponding structure includes a respective rack in the illustrated embodiment, in other embodiments, at least one corresponding structure may include a worm gear. In such embodiments, the actuator coupled to each worm gear (e.g., including electric motor(s), pneumatic motor(s), hydraulic motor(s), other suitable type(s) of motor(s), or a combination thereof) may be configured to drive the worm gear to rotate, thereby driving rotation of the lock ring. Furthermore, in certain embodiments, at least one corresponding structure may include a pawl of a short-stroke ratchet mechanism. The pawl may include teeth configured to engage the toothed surface of the lock ring, and the short-stroke ratchet mechanism may include a biasing member configured to urge the teeth of the pawl to engage the toothed surface of the lock ring. While the teeth of the pawl are engaged with a first set of teeth of the toothed surface of the lock ring, extension of the respective actuator may drive the pawl to rotate the lock ring. In addition, retraction of the respective actuator may drive the pawl to move such that the teeth of the pawl engage a second set of teeth of the toothed surface of the lock ring. The respective actuator may perform multiple extension/retraction cycles to drive the lock ring to rotate from the disengaged position to the engaged position or from the engaged position to the disengaged position. While the toothed surface 108 extends about the entire circumferential extent of the lock ring 60 in the illustrated embodiment, in other embodiments, the toothed surface may only extend around circumferential portion(s) of the lock ring (e.g., such that the portions of the toothed surface are spaced apart from one another along the circumferential axis), in which each portion of the toothed surface is positioned to engage a respective corresponding structure (e.g., rack, worm gear, etc.). In such embodiments, the toothed surface may include any suitable number of portions (e.g., corresponding to the number of corresponding structures), such as 1, 2, 3, 4, 5, 6, or more. For example, at least one portion of the toothed surface (e.g., the only portion of the toothed surface) may include a single tooth (e.g., protrusion), and the corresponding structure (e.g., corresponding protrusion(s), corresponding rack, etc.) may be configured to engage the single tooth. By way of example, a first corresponding structure coupled to a first actuator may be configured to engage a first circumferential surface of the single tooth, a second corresponding structure coupled to a second actuator may be configured to engage a second circumferential surface of the single tooth, the first actuator may be configured to drive the lock ring to rotate in the first direction via engagement of the first corresponding structure with the first circumferential surface of the single tooth, and the second actuator may be configured to drive the lock ring to rotate in the second direction via engagement of the second corresponding structure with the second circumferential surface of the single tooth.

Figure 7:
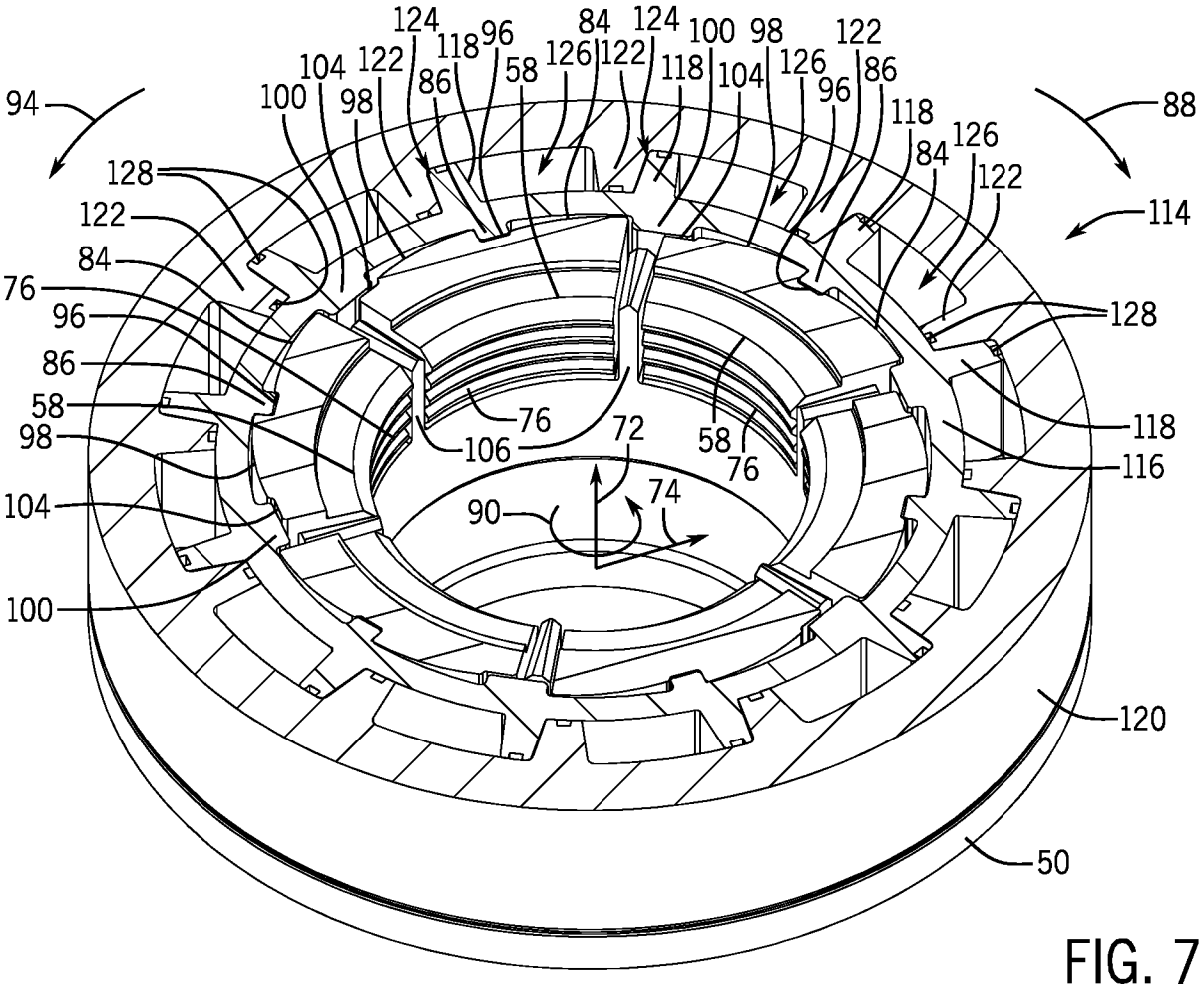
FIG. 7 is a cross-sectional view of another embodiment of a connector assembly that may be employed within the resource extraction system of FIG. 1.

FIG. 7 is a cross-sectional view of another embodiment of a connector assembly 114 that may be employed within the resource extraction system of FIG. 1. In the illustrated embodiment, the lock ring 116 includes multiple vanes 118 configured to drive the lock ring 116 to rotate in response to application of fluid pressure to at least one of the vanes 118. In addition, in the illustrated embodiment, the outer body 120 includes corresponding vanes 122. Each vane 118 of the lock ring 116 is positioned between a corresponding pair of vanes 122 of the outer body 120, and each vane 122 of the outer body 120 is positioned between a corresponding pair of vanes 118 of the lock ring 116. Accordingly, the outer body 120 and the lock ring 116 may establish a first chamber 124 on a first circumferential side of each lock ring vane 118 and a second chamber 126 on a second circumferential side of each lock ring vane 118. Application of fluid pressure to at least one first chamber 124 may drive the lock ring 116 to rotate in the first direction 88 (e.g., if the torque applied by the fluid in the first direction is greater than the torque applied by the fluid in the second direction plus the rotational resistance of the lock ring), and application of fluid pressure to at least one second chamber 126 may drive the lock ring 116 to rotate in the second direction 94 (e.g., if the torque applied by the fluid in the second direction is greater than the torque applied by the fluid in the first direction plus the rotational resistance of the lock ring).

In the illustrated embodiment, each lock ring vane 118 and each outer body vane 122 includes a recess 128 configured to receive a seal. Each seal may be configured to block fluid flow between adjacent chambers. While each lock ring vane 118 and each outer body vane 122 includes a recess 128 for a seal in the illustrated embodiment, in other embodiments, the recess may be omitted from at least one vane (e.g., in embodiments in which another suitable seal is employed to block fluid flow between adjacent chambers, etc.). Furthermore, the fluid applied to each chamber may be any suitable type of fluid, such as hydraulic fluid, water, air, or inert gas. Furthermore, in the illustrated embodiment, the lock ring 116 includes twelve vanes 118, and the outer body 120 includes twelve vanes 122. However, in other embodiments, the lock ring and the outer body may have any suitable number of vanes (e.g., 2, 3, 4, 5, 6, 7, 8, 9, 10, 11, 13, 14, or more). While the outer body has vanes configured to form chambers with the vanes of the lock ring in the illustrated embodiment, in other embodiments, another suitable element of the connector assembly (e.g., the inner body, etc.) may include the vanes configured to form the chambers with the vanes of the lock ring. In addition, the fluid may be provided to the chambers and removed from the chambers via any suitable fluid pathway(s). For example, a fluid inlet passage and a fluid outlet passage may extend through any suitable element(s) (e.g., the outer body, the inner body, the top plate, etc.) of the connector assembly to each chamber. Furthermore, in certain embodiments, a single fluid passage may extent through any suitable element(s) of the connector assembly to each chamber, in which the single fluid passage provides fluid to and removes fluid from the chamber. One or more valves may be used to control the fluid flow to and from each chamber.

By way of example, fluid pressure may be applied to at least one first chamber 124, thereby driving the lock ring 116 to rotate in the first direction 88 along the circumferential axis 90 to the engaged position. As a result, each driver 86 moves along the cam surface 84 of a respective dog 58, and each second driver 100 moves along the second cam surface 98 of the respective dog 58, thereby driving the respective dog 58 along the radial axis 74 to the locked position. As previously discussed, with each dog 58 in the locked position, the teeth 76 of the dog engage the corresponding teeth of the tubing spool, and the lug of the dog 58 engages the corresponding recess of the production tree. In addition, fluid pressure may be applied to at least one second chamber 126, thereby driving the lock ring 116 to rotate in the second direction 94 along the circumferential axis 90 to the illustrated disengaged position. As a result, each driver 86 aligns with the recess 96 of a respective dog 58, and each second driver 100 aligns with the second recess 104 of the respective dog 58, thereby enabling the respective dog 58 to move outwardly along the radial axis 74 to the illustrated unlocked position. As previously discussed, with each dog 58 in the unlocked position, the teeth 76 of the dog disengage the corresponding teeth of the tubing spool, and the lug of the dog 58 disengages the corresponding recess of the production tree. For example, as previously discussed, the teeth of the dogs may be shaped to drive the dogs outwardly along the radial axis in response to movement of the tubing spool away from the connector assembly along the longitudinal axis, and/or the connector assembly may include one or more biasing devices (e.g., split ring(s), spring(s), etc.) configured to urge each dog outwardly along the radial axis toward the unlocked position. In certain embodiments, fluid pressure may be applied to a fewer number of first and second chambers during normal operation (e.g., about 75 percent of the first/second chambers, etc.), and fluid pressure may be applied to a larger number of second chambers (e.g., 100 percent of the second chambers, etc.) in conditions in which applying fluid pressure to the fewer number of second chambers provides insufficient torque to drive the lock ring to the disengaged position.

Figure 8:
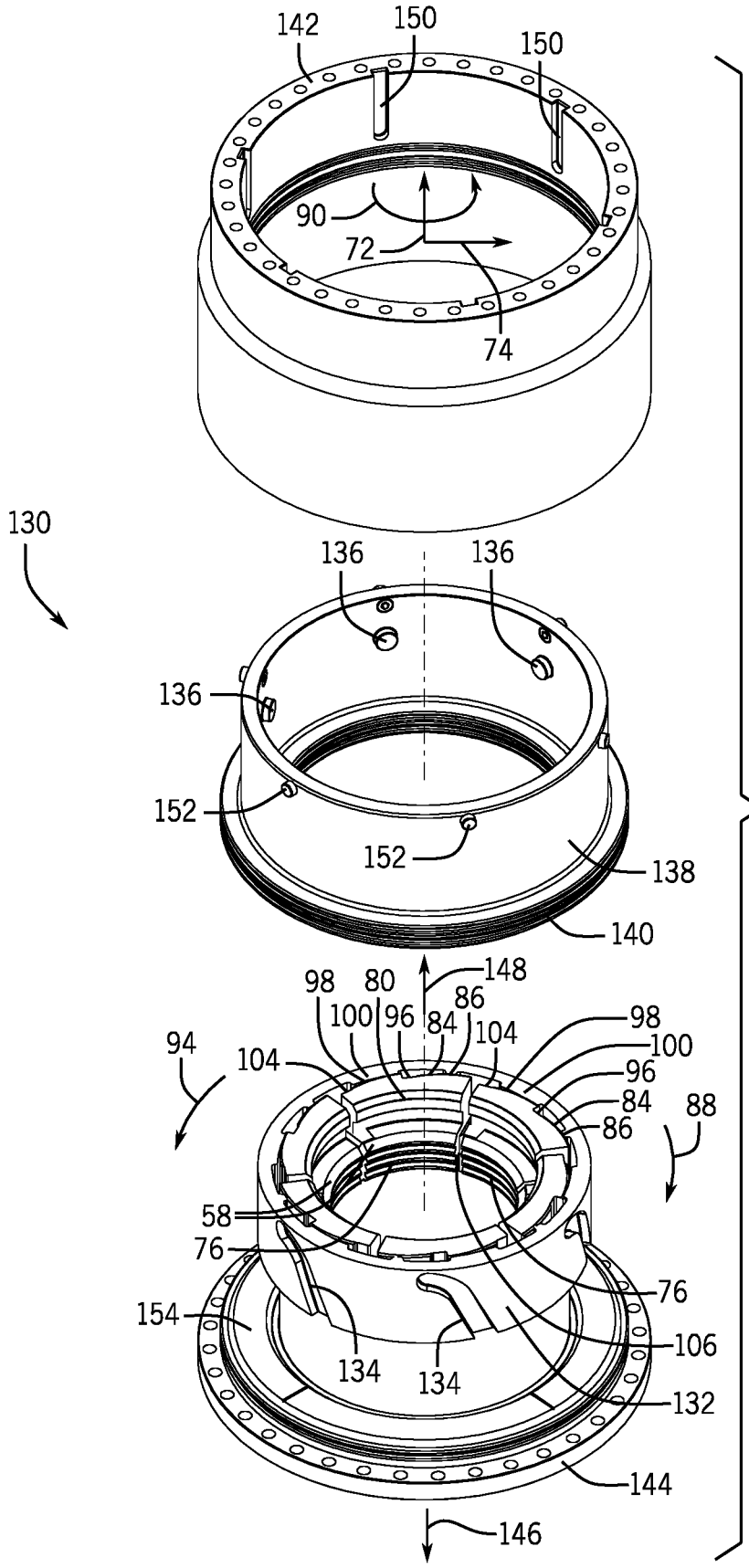
FIG. 8 is an exploded view of a portion of a further embodiment of a connector assembly that may be employed within the resource extraction system of FIG. 1.

FIG. 8 is an exploded view of a portion of a further embodiment of a connector assembly 130 that may be employed within the resource extraction system of FIG. 1. In the illustrated embodiment, the lock ring 132 includes multiple slots 134, and the connector assembly 130 includes multiple pins 136 configured to engage the slots 134. The pins 136 are configured to drive the lock ring 132 to rotate along the circumferential axis 90 in response to movement of the pins 136 through the slots 134. In the illustrated embodiment, the pins 136 are coupled (e.g., integrally formed with, coupled by a welded connection, coupled by a threaded connection, etc.) to a piston assembly 138 configured to drive the pins 136 to move along the longitudinal axis 72. The piston assembly 138 includes a piston 140 configured to be disposed within an annular cavity formed by the outer body 142, the inner body 144 and the lock ring 132. The piston 140 divides the annular cavity into a first chamber and a second chamber, in which the first chamber is positioned above the second chamber. Applying fluid pressure to the first chamber drives the piston assembly 138 and the pins 136 in a downward direction 146 along the longitudinal axis 72 (e.g., if the force applied by the fluid in the first chamber is greater than the force applied by the fluid in the second chamber plus the force caused by the rotational resistance of the lock ring), and applying fluid pressure to the second chamber drives the piston assembly 138 and the pins 136 in an upward direction 148 along the longitudinal axis 72 (e.g., if the force applied by the fluid in the second chamber is greater than the force applied by the fluid in the first chamber plus the force caused by the rotational resistance of the lock ring). In the illustrated embodiment, the slots 134 are configured to drive the lock ring 132 to rotate in the first direction 88 along the circumferential axis 90 in response to downward movement of the pins 136 and to drive the lock ring 132 to rotate in the second direction 94 along the circumferential axis 90 in response to upward movement of the pins 136. Accordingly, applying fluid pressure to the first chamber drives the lock ring 88 to rotate in the first direction 88 toward the engaged position, and applying fluid pressure to the second chamber drives the lock ring 132 to rotate in the second direction 90 toward the disengaged position.

In the illustrated embodiment, the outer body 142 has multiple slots 150, and multiple pins 152 are coupled (e.g., integrally formed with, coupled by a welded connection, coupled by a threaded connection, etc.) to the piston assembly 138. The pins 152 are configured to engage the slots 150 of the outer body 142, thereby substantially blocking rotation of the piston assembly 138 along the circumferential axis 90 with respect to the outer body 142. Accordingly, the piston assembly 138 may be driven substantially along the longitudinal axis 72 to drive the lock ring 132 to rotate. In the illustrated embodiment, six pins 152 are coupled to the piston assembly 138, and the outer body 142 includes six corresponding slots 150. However, in other embodiments, more or fewer pins may be coupled to the piston assembly, and the outer body may have a corresponding number of slots. Furthermore, while the connector assembly 130 includes a first set of pins 136 for the lock ring slots 134 and a second set of pins 152 for the outer body slots 150 in the illustrated embodiment, in other embodiments, a single set of pins may extend through the piston assembly and engage the lock ring slots and the outer body slots. In addition, while rotation of the piston assembly 138 relative to the outer body 142 is substantially blocked by the pins 152 coupled to the piston assembly 138 and the slots 150 in the outer body 142 in the illustrated embodiment, in other embodiments, the connector assembly may include other suitable system(s) configured to block rotation of the piston assembly 138 along the circumferential axis with respect to the outer body (e.g., pin(s) of the outer body may engage corresponding slot(s) of the piston assembly, protrusion(s) of one part may engage groove(s) of the other part, track assembly/assemblies may be disposed between the piston assembly and the outer body, etc.).

By way of example, fluid pressure may be applied to the first chamber, thereby driving the piston assembly 138 to move in the downward direction 146 along the longitudinal axis 72. As a result, the pins 136 drive the lock ring 132 to rotate in the first direction 88 along the circumferential axis 90 to the engaged position. Accordingly, each driver 86 moves along the cam surface 84 of a respective dog 58, and each second driver 100 moves along the second cam surface 98 of the respective dog 58, thereby driving the respective dog 58 along the radial axis 74 to the locked position. As previously discussed, with each dog 58 in the locked position, the teeth 76 of the dog engage the corresponding teeth of the tubing spool, and the lug 80 of the dog 58 engages the corresponding recess of the production tree. In addition, fluid pressure may be applied to the second chamber, thereby driving the piston assembly 138 to move in the upward direction 148 along the longitudinal axis 72. As a result, the pins 136 drive the lock ring 116 to rotate in the second direction 94 along the circumferential axis 90 to the disengaged position. Accordingly, each driver 86 aligns with the recess 96 of a respective dog 58, and each second driver 100 aligns with the second recess 104 of the respective dog 58, thereby enabling the respective dog 58 to move outwardly along the radial axis 74 to the unlocked position. As previously discussed, with each dog 58 in the unlocked position, the teeth 76 of the dog disengage the corresponding teeth of the tubing spool, and the lug 80 of the dog 58 disengages the corresponding recess of the production tree. For example, as previously discussed, the teeth of the dogs may be shaped to drive the dogs outwardly along the radial axis in response to movement of the tubing spool away from the connector assembly along the longitudinal axis, and/or the connector assembly may include one or more biasing devices (e.g., split ring(s), spring(s), etc.) configured to urge each dog outwardly along the radial axis toward the unlocked position.

In the illustrated embodiment, the connector assembly 130 includes a secondary unlock piston 154 positioned below the second chamber. During normal operation, fluid pressure may be applied to the first and second chambers, as described above, to drive the lock ring between the engaged and disengaged positions. However, in conditions in which applying pressurized fluid to the second chamber provides insufficient force to drive the lock ring to the disengaged position, higher pressure fluid may be applied to a third chamber positioned below the secondary unlock piston, thereby providing additional force to drive the lock ring to the disengaged position. While the connector assembly 130 includes the secondary unlock piston 154 in the illustrated embodiment, in other embodiments, the secondary unlock piston may be omitted.

While the connector assembly 130 includes six pins 136 configured to engage six corresponding slots 134 of the lock ring 132 in the illustrated embodiment, in other embodiments, the connector assembly may include more or fewer pins (e.g., 1, 2, 3, 4, 5, 7, 8, or more), and the lock ring may have a corresponding number of slots. Furthermore, in certain embodiments, the pin(s) may be coupled to the lock ring, and the corresponding slot(s) may be formed in the piston assembly. In addition, while pins and slots are used to drive the lock ring to rotate in response to longitudinal movement of the piston assembly in the illustrated embodiment, in other embodiments, a cam and driver configuration may be used to drive the lock ring to rotate in response to longitudinal movement of the piston assembly. Furthermore, in the illustrated embodiment, the slots 134 of the lock ring 132 have a contoured/angled shape, and the slots 150 of the outer body 142 extend substantially along the vertical axis 72. However, in other embodiments, the slots of the lock ring may extend substantially along the vertical axis, and the slots of the outer body may have a contoured/angled shape. In such embodiments, the piston assembly may be driven to rotate relative to the outer body in response to movement of the piston assembly along the longitudinal axis, and the piston assembly may be substantially non-rotatably coupled to the lock ring. Accordingly, movement of the piston assembly along the longitudinal axis drives the lock ring to rotate along the circumferential axis. Furthermore, in such embodiments, the connector assembly may include any suitable anti-rotation system(s) between the lock ring and the piston assembly (e.g., alone or in combination with the pin(s)/slot(s)), such as one or more of the anti-rotation system(s) disclosed above, and/or a cam and driver configuration may be used to drive the piston assembly to rotate in response to longitudinal movement of the piston assembly. In addition, while the piston assembly is configured to interact with the outer body (e.g., via the pins) in the illustrated embodiment, in other embodiments, the piston assembly may be configured to interact with another suitable element (e.g., the inner body, etc.), such as via a pin and slot configuration. While a piston assembly is used to drive the lock ring to rotate in the illustrated embodiment, in other embodiments, other suitable actuator(s) may be used to drive the lock ring to rotate. For example, in certain embodiments, an electromechanical actuator may be coupled to the pin(s) engaged with the slot(s) of the lock ring and configured to drive the pin(s) to move along the longitudinal axis. Furthermore, while downward movement of the pin(s)/piston assembly drives the lock ring to rotate in the first direction and upward movement of the pin(s)/piston assembly drives the lock ring to rotate in the second direction in the illustrated embodiment, in other embodiments, element(s) of the connector assembly (e.g., the slot(s) of the lock ring, etc.) may be configured to drive the lock ring to rotate in the first direction in response to upward movement of the pin(s)/piston assembly and to drive the lock ring to rotate in the second direction in response to downward movement of the pin(s)/piston assembly.

Figure 9:
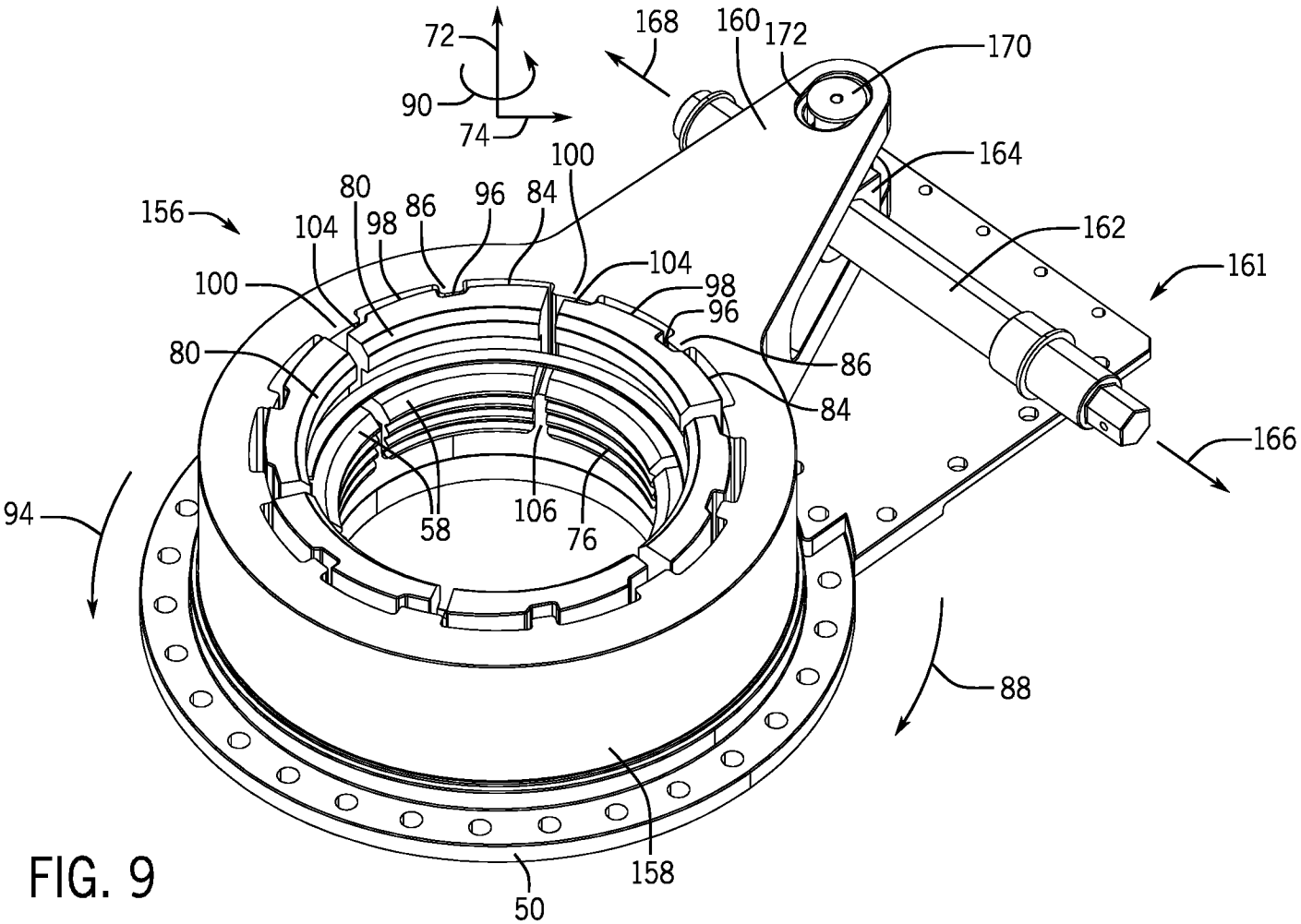
FIG. 9 is a perspective view of a portion of another embodiment of a connector assembly that may be employed within the resource extraction system of FIG. 1.

FIG. 9 is a perspective view of a portion of another embodiment of a connector assembly 156 that may be employed within the resource extraction system of FIG. 1. In the illustrated embodiment, the lock ring 158 includes a protrusion 160 configured to engage an actuator 161, and the protrusion 160 is configured to drive the lock ring 158 to rotate in response to movement of the actuator 161. Furthermore, in the illustrated embodiment, the actuator 161 includes a threaded shaft 162 configured to be driven in rotation. The threaded shaft 162 may be driven to rotate by any suitable motor(s), such as electric motor(s), hydraulic motor(s), pneumatic motor(s), other suitable type(s) of motor(s), or a combination thereof. In addition, the threaded shaft 162 is engaged with a mount 164 having internal threads. Accordingly, rotation of the threaded shaft 162 in a first rotational direction drives the mount 164 to move in a first translational direction 166, and rotation of the threaded shaft 162 in a second rotational direction, opposite the first rotational direction, drives the mount 164 to move in a second translational direction 168. In the illustrated embodiment, the mount 164 is pivotally coupled to the protrusion 160 via a pin 170 disposed within a slot 172 of the protrusion 160. However, in other embodiments, the mount may be coupled to the protrusion via any other suitable connection system. For example, in certain embodiments, the pin may be non-movably coupled to the protrusion, and the pin may be movably coupled to the mount (e.g., via a slot within the mount). Furthermore, in the illustrated embodiment, flat surfaces of the mount 164 engage corresponding flat surfaces of the protrusion 160 to substantially block rotation of the mount about the rotational axis of the threaded shaft 162. However, in other embodiments, rotation of the mount relative to the protrusion along the rotational axis of the threaded shaft may be blocked by other/additional suitable surface(s) and/or device(s).

By way of example, the threaded shaft 162 of the actuator may be driven to rotate in the first rotational direction, thereby driving the protrusion 160 to move in the first translational direction 166. As a result, the lock ring 158 is driven to rotate in the first direction 88 along the circumferential axis 90 to the engaged position. Accordingly, each driver 86 moves along the cam surface 84 of a respective dog 58, and each second driver 100 moves along the second cam surface 98 of the respective dog 58, thereby driving the respective dog 58 along the radial axis 74 to the locked position. As previously discussed, with each dog 58 in the locked position, the teeth 76 of the dog engage the corresponding teeth of the tubing spool, and the lug 80 of the dog 58 engages the corresponding recess of the production tree. In addition, the threaded shaft 162 of the actuator may be driven to rotate in the second rotational direction, thereby driving the protrusion to move in the second translational direction 168. As a result, the lock ring 158 is driven to rotate in the second direction 94 along the circumferential axis 90 to the illustrated disengaged position. Accordingly, each driver 86 aligns with the recess 96 of a respective dog 58, and each second driver 100 aligns with the second recess 104 of the respective dog 58, thereby enabling the respective dog 58 to move outwardly along the radial axis 74 to the illustrated unlocked position. As previously discussed, with each dog 58 in the unlocked position, the teeth 76 of the dog disengage the corresponding teeth of the tubing spool, and the lug 80 of the dog 58 disengages the corresponding recess of the production tree. For example, as previously discussed, the teeth of the dogs may be shaped to drive the dogs outwardly along the radial axis in response to movement of the tubing spool away from the connector assembly along the longitudinal axis, and/or the connector assembly may include one or more biasing devices (e.g., split ring(s), spring(s), etc.) configured to urge each dog outwardly along the radial axis toward the unlocked position.

While the actuator includes a threaded shaft 162 engaged with an internally threaded mount 164 in the illustrated embodiment, in other embodiments, the actuator may include a linear actuator configured to directly drive the protrusion to move in the first and second translational directions. For example, the linear actuator may include a hydraulic cylinder, a pneumatic cylinder, an electromechanical actuator, or a combination thereof. Furthermore, while the lock ring 158 includes a single protrusion 160 in the illustrated embodiment, in other embodiments, the lock ring may include multiple protrusions, and each protrusion may be configured to engage a corresponding actuator. While lock rings driven to rotate by multiple vanes, a toothed surface, a protrusion, and a pin/slot configuration are disclosed above, in other embodiments, the lock ring may be driven to rotate by any other suitable system(s)/device(s)/mechanism(s). In addition, while the first direction 88 (e.g., direction of rotation toward the engaged position) is clockwise and the second direction 94 (e.g., direction of rotation toward the disengaged position) is counter-clockwise in the illustrated embodiment, in other embodiments, the first direction may be counter-clockwise, and the second direction may be clockwise. Furthermore, while the lock ring is driven to rotate in the embodiments disclosed above, in certain embodiments, the dog(s) may be driven to rotate along the circumferential axis relative to the lock ring. For example, the lock ring may be fixed relative to the outer body/inner body/top plate, and the dog(s) may be driven to rotate, or the lock ring and the dog(s) may be driven to rotate in opposite directions. In certain embodiments, the dog(s) may be driven to rotate by the spacers, and the spacers may be driven to rotate by the element coupled to the spacers (e.g., the inner body, the outer body, the top plate, etc.). Furthermore, the element may be driven to rotate by any of the driving systems disclosed above (e.g., the vanes, the toothed surface, the protrusion, the pin/slot configuration, etc.).

Figure 10:
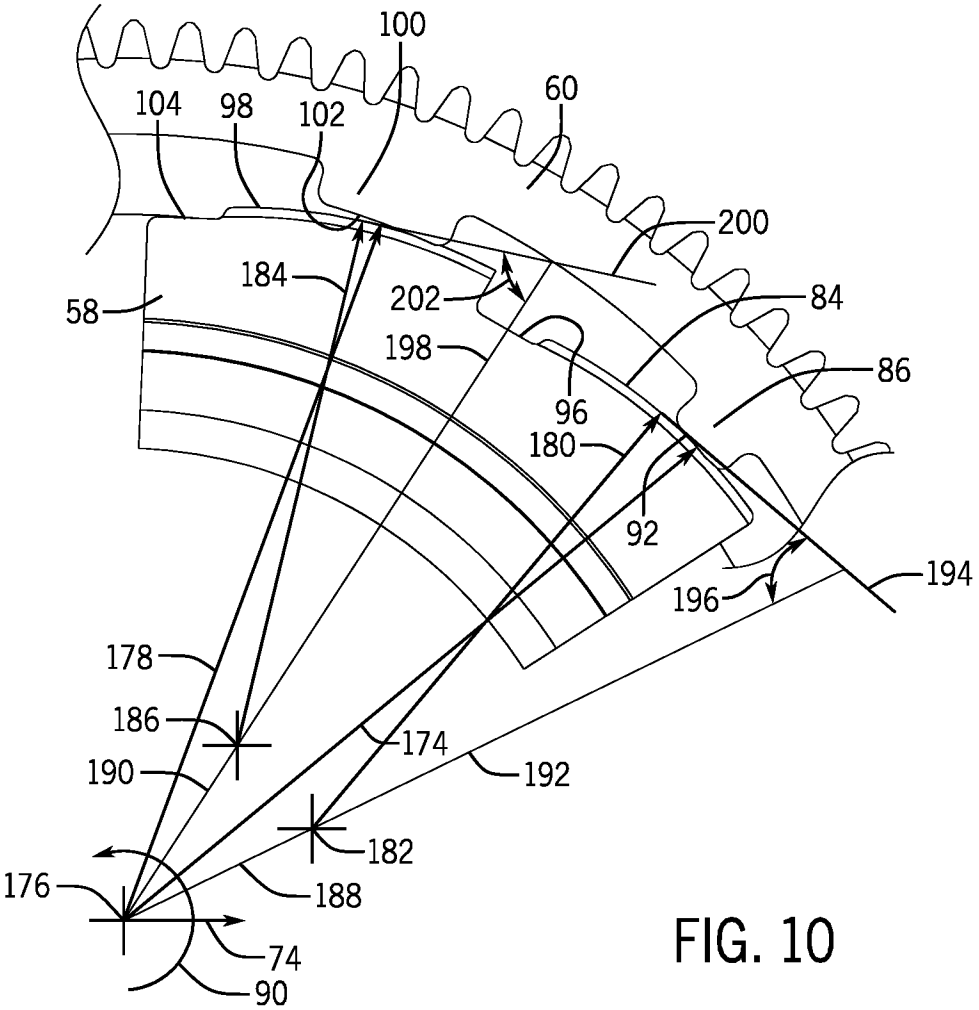
FIG. 10 is a top view of an embodiment of a dog and a portion of a lock ring that may be employed within any of the connector assemblies of FIGS. 2-9.

FIG. 10 is a top view of an embodiment of a dog 58 and a portion of a lock ring 60 that may be employed within any of the connector assemblies of FIGS. 2-9. As previously discussed, the engagement surface 92 of the driver 86 is configured to engage the cam surface 84 of the dog 58, and the engagement surface 102 of the second driver 100 is configured to engage the second cam surface 98 of the dog 58. As illustrated, a first lock ring radius 174 extends from a center 176 of the lock ring 60 to the engagement surface 92 (e.g., the circumferential midpoint of the engagement surface 92) of the driver 86, and a second lock ring radius 178 extends from the center 176 of the lock ring 60 to the engagement surface 102 (e.g., the circumferential midpoint of the engagement surface 102) of the second driver 100. In the illustrated embodiment, the first lock ring radius 174 is equal to the second lock ring radius 178. However, in other embodiments, the first lock ring radius may be different than the second lock ring radius. Furthermore, at least one lock ring radius may be constant along the respective engagement surface, and/or at least one lock ring radius may vary along the respective engagement surface (e.g., the respective engagement surface may be substantially flat, etc.).

In the illustrated embodiment, the cam surface 84 and the second cam surface 98 are formed as substantially constant radius curved surfaces that are eccentric with respect to the lock ring engagement surfaces. As illustrated, a first cam radius 180 extends from a first cam center 182 to the cam surface 84, and a second cam radius 184 extends from a second cam center 186 to the second cam surface 98. The first cam radius 180 may be the same or different than the second cam radius 184. As illustrated, the first cam center 182 and the second cam center 186 are offset from the center 176 of the lock ring 60, thereby establishing the eccentricity of the cam surfaces. In the illustrated embodiment, the first cam center 182 is offset from the center 176 of the lock ring 60 by a first distance 188 (e.g., first offset distance), and the second cam center 186 is offset from the center 176 of the lock ring 60 by a second distance 190 (e.g., second offset distance). A first eccentricity ratio may be determined by dividing the first distance 188 by the first lock ring radius 174, and a second eccentricity ratio may be determined by dividing the second distance 190 by the second lock ring radius 178. The eccentricity ratio may be representative of the degree of eccentricity of the respective cam surface. The first eccentricity ratio may be the same or different than the second eccentricity ratio. In certain embodiments, each eccentricity ratio may be in the range of about 0.01 to about 5, about 0.01 to about 4, about 0.1 to about 3, or about 0.01 to about 4.

Furthermore, a first line 192 extending through the center 176 of the lock ring 60 and the first cam center 182 intersects a first tangent line 194 at a first angle 196. In the illustrated embodiment, the first tangent line 194 is tangent to the circumferential midpoint of the cam surface 84. In addition, a second line 198 extending through the center 176 of the lock ring 60 and the second cam center 186 intersects a second tangent line 200 at a second angle 202. In the illustrated embodiment, the second tangent line 200 is tangent to the circumferential midpoint of the second cam surface 98. The angle may be representative of the degree of eccentricity of the respective cam surface. The first angle 196 may be the same or different than the second angle 202. In certain embodiments, each angle may be between about 0 degrees and about 90 degrees, between about 10 degrees and about 80 degrees, or between about 20 degrees and about 80 degrees.

While the cam surfaces of the dogs are described above, in embodiments in which the cam surfaces are formed on the lock ring, the eccentricity ratio and the angle of each cam surface may be determined similarly to the manner described above. Furthermore, while each cam surface is formed as a substantially constant radius curved surface in the illustrated embodiment, in other embodiments, at least one cam surface may be formed as another suitable shape. For example, in certain embodiments, at least one cam surface may be formed as a substantially flat surface. Additionally or alternatively, in certain embodiments, at least one cam surface may be formed as a spiral surface, in which the radius of curvature progressively decreases along the first direction or the second direction.

Technical effects of the disclosure include reducing the size, weight, and cost of a connector assembly for multiple components (e.g., resource extraction system components). For example, the connector assembly includes a lock ring disposed about the dog(s) along a circumferential axis of the connector assembly. Accordingly, the longitudinal extent (e.g., height) of the connector assembly may be reduced (e.g., as compared to a connector assembly having an actuator that moves along the longitudinal axis). As a result, the weight and the cost of the connector assembly may be significantly reduced. In addition, in certain embodiments, the dog(s) are configured to engage both components. Accordingly, longitudinal forces (e.g., longitudinal forces driving the components away from one another along the longitudinal axis) may extend directly through the dog(s). As a result, the weight and the cost of the connector assembly may be reduced (e.g., as compared to a connector assembly in which one component is bolted to a body of the connector assembly, and the connector assembly elements have sufficient thickness to resist the loading caused by the longitudinal forces flowing along a tortuous path through the connector assembly between the components).

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A connector assembly for a plurality of components, comprising:

a dog comprising a first engagement feature and a second engagement feature, wherein the first engagement feature is configured to engage a first component of the plurality of components while the dog is in a locked position and to disengage the first component while the dog is in an unlocked position, and the second engagement feature is configured to engage a second component of the plurality of components while the dog is in the locked position and to disengage the second component while the dog is in the unlocked position; and a lock ring disposed about the dog along a circumferential axis of the connector assembly;

wherein one of the dog or the lock ring comprises a cam surface, the other of the dog or the lock ring comprises a driver, and the driver is configured to move along the cam surface in response to rotation of the lock ring, the dog, or a combination thereof, along the circumferential axis to drive the dog to the locked position.

2. The connector assembly of claim 1, wherein an engagement surface of the driver is configured to engage the cam surface at a self-locking angle while the dog is in the locked position.

3. The connector assembly of claim 1, wherein a recess is positioned adjacent to the cam surface, and the recess is configured to receive the driver while the dog is in the unlocked position.

4. The connector assembly of claim 1, wherein the lock ring comprises a protrusion configured to engage an actuator, wherein the protrusion is configured to drive the lock ring to rotate in response to movement of the actuator.

5. The connector assembly of claim 1, comprising a pin configured to engage a slot and to drive the lock ring to rotate in response to movement of the pin through the slot.

6. A connector assembly for a plurality of components, comprising:

a plurality of dogs, wherein each dog of the plurality of dogs comprises a first engagement feature and a second engagement feature, wherein the first engagement feature is configured to engage a first component of the plurality of components while the dog is in a locked position and to disengage the first component while the dog is in an unlocked position, the second engagement feature is configured to engage a second component of the plurality of components while the dog is in the locked position and to disengage the second component while the dog is in the unlocked position, and each dog of the plurality of dogs has a cam surface; and a lock ring disposed about the plurality of dogs along a circumferential axis of the connector assembly, wherein the lock ring comprises a plurality of drivers, and each driver of the plurality of drivers is configured to move along the cam surface of a respective dog of the plurality of dogs in response to rotation of the lock ring along the circumferential axis to drive the respective dog to the locked position.

7. The connector assembly of claim 6, wherein an engagement surface of each driver of the plurality of drivers is configured to engage the cam surface of a respective dog of the plurality of dogs at a self-locking angle while the respective dog is in the locked position.

8. The connector assembly of claim 6, wherein each dog of the plurality of dogs comprises a recess configured to receive a respective driver of the plurality of drivers while the dog is in the unlocked position.

9. The connector assembly of claim 6, comprising an actuator engaged with a protrusion of the lock ring, wherein the actuator is configured to drive the lock ring to rotate.

10. The connector assembly of claim 6, comprising a pin configured to engage a slot and to drive the lock ring to rotate in response to movement of the pin through the slot.

11. A connector assembly for a plurality of components, comprising:

a dog comprising a first engagement feature and a second engagement feature, wherein the first engagement feature is configured to engage a first component of the plurality of components while the dog is in a locked position and to disengage the first component while the dog is in an unlocked position, and the second engagement feature is configured to engage a second component of the plurality of components while the dog is in the locked position and to disengage the second component while the dog is in the unlocked position; and a lock ring disposed about the dog along a circumferential axis of the connector assembly;

wherein the dog comprises a cam surface, the lock ring comprises a driver, an engagement surface of the driver is configured to engage the cam surface, the cam surface is eccentric with respect to the engagement surface, and the driver is configured to move along the cam surface in response to rotation of the lock ring along the circumferential axis to drive the dog to the locked position.

12. The connector assembly of claim 11, wherein the cam surface is formed as a substantially constant radius curved surface.

13. The connector assembly of claim 11, wherein an eccentricity ratio of the cam surface is between about 0.01 and about 5, the eccentricity ratio is determined by dividing an offset distance by a lock ring radius, the lock ring radius extends from a center of the lock ring to the engagement surface of the driver, the offset distance is a distance between a cam center and the center of the lock ring, and the cam center is an origin of a cam radius extending to the cam surface.

14. The connector assembly of claim 11, wherein the engagement surface of the driver is configured to engage the cam surface at a self-locking angle while the dog is in the locked position.

15. The connector assembly of claim 11, wherein the first engagement feature comprises teeth, and the second engagement feature comprises a lug.

16. The connector assembly of claim 1, wherein the first engagement feature comprises teeth, and the second engagement feature comprises a lug.

* * * * *